US007637602B2

(12) United States Patent
Silverbrook et al.

(10) Patent No.: US 7,637,602 B2
(45) **Date of Patent: *Dec. 29, 2009**

(54) PRINTER WITH INK FLOW SHUTOFF VALVE

(75) Inventors: Kia Silverbrook, Balmain (AU); Akira Nakazawa, Balmain (AU); Jonathan Mark Bulman, Balmain (AU); Vesa Karppinen, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 418 days.

This patent is subject to a terminal disclaimer.

(21) Appl. No.: 11/482,983

(22) Filed: Jul. 10, 2006

(65) Prior Publication Data

US 2007/0206069 A1 Sep. 6, 2007

(30) Foreign Application Priority Data

| | | |
|---|---|---|
| Mar. 3, 2006 | (AU) | 2006901084 |
| Mar. 7, 2006 | (AU) | 2006901287 |
| Mar. 15, 2006 | (AU) | 2006201083 |
| Mar. 15, 2006 | (AU) | 2006201084 |
| Mar. 15, 2006 | (AU) | 2006201204 |

(51) Int. Cl.
*B41J 2/175* (2006.01)
*B41J 2/165* (2006.01)

(52) U.S. Cl. ..... 347/85; 347/35; 347/29

(58) Field of Classification Search ..... 347/84–87, 347/22–36

See application file for complete search history.

(56) References Cited

U.S. PATENT DOCUMENTS

| | | | | |
|---|---|---|---|---|
| 6,033,060 | A * | 3/2000 | Minami | 347/85 |
| 6,241,350 | B1 * | 6/2001 | Otsuka et al. | 347/94 |
| 6,485,137 | B2 * | 11/2002 | Karlinski et al. | 347/92 |
| 6,557,988 | B1 * | 5/2003 | Hartman | 347/85 |
| 6,568,802 | B2 * | 5/2003 | Galan et al. | 347/94 |
| 6,609,780 | B2 * | 8/2003 | Sugiyama | 347/33 |
| 6,692,109 | B2 * | 2/2004 | Hirota et al. | 347/54 |
| 6,719,404 | B2 * | 4/2004 | Kobayashi | 347/54 |
| 6,830,325 | B2 * | 12/2004 | Hirota et al. | 347/94 |
| 7,004,574 | B2 * | 2/2006 | Neese et al. | 347/85 |
| 7,290,849 | B2 * | 11/2007 | Yamazaki et al. | 347/19 |
| 7,370,923 | B2 * | 5/2008 | Tanno et al. | 347/7 |
| 7,530,663 | B2 * | 5/2009 | Karppinen et al. | 347/22 |
| 2002/0047882 | A1 | 4/2002 | Karlinski et al. | |
| 2004/0113997 | A1 * | 6/2004 | Silverbrook et al. | 347/85 |
| 2004/0183870 | A1 * | 9/2004 | Steinmetz et al. | 347/85 |
| 2005/0151802 | A1 | 7/2005 | Neese et al. | |
| 2006/0007254 | A1 | 1/2006 | Tanno et al. | |
| 2006/0164472 | A1 * | 7/2006 | Perez | 347/85 |
| 2006/0164473 | A1 * | 7/2006 | Davis et al. | 347/85 |
| 2007/0206068 | A1 * | 9/2007 | Brown et al. | 347/85 |

FOREIGN PATENT DOCUMENTS

| | | |
|---|---|---|
| EP | 1336486 A2 | 8/2003 |
| EP | 0921000 B1 | 4/2004 |
| EP | 0978383 B1 | 5/2005 |

* cited by examiner

*Primary Examiner*—Stephen D Meier
*Assistant Examiner*—Rene Garcia, Jr.

(57) ABSTRACT

An inkjet printer with a printhead integrated circuit (IC) (28), an ink supply reservoir (6) for storing ink, an ink supply line (3) defining a flow path from the ink supply reservoir to the printhead IC, and a valve (22) in the ink supply line proximate the printhead IC selectively closing the flow path to the printhead IC.

13 Claims, 4 Drawing Sheets

PRINTER WITH INK FLOW SHUTOFF VALVE

FIELD OF THE INVENTION

The present invention relates to the field of printing and in particular inkjet printing.

CO-PENDING APPLICATIONS

The following applications have been filed by the Applicant simultaneously with the present application:

| | | | | |
|---|---|---|---|---|
| 11/482,975 | 11/482,970 | 11/482,968 | 11/482,972 | 11/482,971 |
| 11/482,969 | 11/482,958 | 7,467,846 | 11/482,962 | 11/482,963 |
| 11/482,956 | 11/482,954 | 11/482,974 | 11/482,957 | 11/482,987 |
| 11/482,959 | 11/482,960 | 11/482,961 | 11/482,964 | 11/482,965 |
| 11/482,976 | 11/482,973 | 11/482,990 | 11/482,986 | 11/482,985 |
| 11/482,980 | 11/482,967 | 11/482,966 | 11/482,988 | 11/482,989 |
| 11/482,979 | 11/482,953 | 11/482,977 | 11/482,981 | 11/482,978 |
| 11/482,982 | 11/482,984 | | | |

The disclosures of these co-pending applications are incorporated herein by reference. The above applications have been identified by their filing docket number, which will be substituted with the corresponding application number, once assigned.

CROSS REFERENCES TO RELATED APPLICATIONS

Various methods, systems and apparatus relating to the present invention are disclosed in the following US Patents/Patent Applications filed by the applicant or assignee of the present invention:

| | | | | |
|---|---|---|---|---|
| 6,750,901 | 6,476,863 | 6,788,336 | 7,249,108 | 6,566,858 |
| 6,331,946 | 6,246,970 | 6,442,525 | 7,346,586 | 09/505,951 |
| 6,374,354 | 7,246,098 | 6,816,968 | 6,757,832 | 6,334,190 |
| 6,745,331 | 7,249,109 | 7,197,642 | 7,093,139 | 10/636,263 |
| 10/636,283 | 10/866,608 | 7,210,038 | 7,401,223 | 10/940,653 |
| 10/942,858 | 7,364,256 | 7,258,417 | 7,293,853 | 7,328,968 |
| 7,270,395 | 7,461,916 | 11/003,419 | 7,334,864 | 7,255,419 |
| 7,284,819 | 7,229,148 | 7,258,416 | 7,273,263 | 7,270,393 |
| 6,984,017 | 7,347,526 | 7,357,477 | 7,465,015 | 7,364,255 |
| 7,357,476 | 11/003,614 | 7,284,820 | 7,341,328 | 7,246,875 |
| 7,322,669 | 7,445,311 | 7,452,052 | 7,455,383 | 7,448,724 |
| 7,441,864 | 11/246,676 | 7,472,981 | 7,448,722 | 11/246,679 |
| 7,438,381 | 7,441,863 | 7,438,382 | 7,425,051 | 7,399,057 |
| 11/246,671 | 11/246,670 | 11/246,669 | 7,448,720 | 7,448,723 |
| 7,445,310 | 7,399,054 | 7,425,049 | 7,367,648 | 7,370,936 |
| 7,401,886 | 11/246,708 | 7,401,887 | 7,384,119 | 7,401,888 |
| 7,387,358 | 7,413,281 | 6,623,101 | 6,406,129 | 6,505,916 |
| 6,457,809 | 6,550,895 | 6,457,812 | 7,152,962 | 6,428,133 |
| 7,204,941 | 7,282,164 | 7,465,342 | 7,278,727 | 7,417,141 |
| 7,452,989 | 7,367,665 | 7,138,391 | 7,153,956 | 7,423,145 |
| 7,456,277 | 10/913,376 | 7,122,076 | 7,148,345 | 11/172,816 |
| 7,470,315 | 11/172,814 | 7,416,280 | 7,252,366 | 10/683,064 |
| 7,360,865 | 7,438,371 | 7,465,017 | 7,441,862 | 11/293,841 |
| 7,458,659 | 11/293,796 | 11/293,797 | 7,455,376 | 6,746,105 |
| 11/246,687 | 11/246,718 | 7,322,681 | 11/246,686 | 11/246,703 |
| 11/246,691 | 11/246,711 | 7,465,041 | 11/246,712 | 7,465,032 |
| 7,401,890 | 7,401,910 | 7,470,010 | 11/246,702 | 7,431,432 |
| 7,465,037 | 7,445,317 | 11/246,699 | 11/246,675 | 11/246,674 |
| 11/246,667 | 7,156,508 | 7,159,972 | 7,083,271 | 7,165,834 |
| 7,080,894 | 7,201,469 | 7,090,336 | 7,156,489 | 7,413,283 |
| 7,438,385 | 7,083,257 | 7,258,422 | 7,255,423 | 7,219,980 |
| 10/760,253 | 7,416,274 | 7,367,649 | 7,118,192 | 10/760,194 |
| 7,322,672 | 7,077,505 | 7,198,354 | 7,077,504 | 10/760,189 |
| 7,198,355 | 7,401,894 | 7,322,676 | 7,152,959 | 7,213,906 |

-continued

| | | | | |
|---|---|---|---|---|
| 7,178,901 | 7,222,938 | 7,108,353 | 7,104,629 | 7,303,930 |
| 11/246,672 | 7,401,405 | 7,464,466 | 7,464,465 | 7,246,886 |
| 7,128,400 | 7,108,355 | 6,991,322 | 7,287,836 | 7,118,197 |
| 10/728,784 | 7,364,269 | 7,077,493 | 6,962,402 | 10/728,803 |
| 7,147,308 | 10/728,779 | 7,118,198 | 7,168,790 | 7,172,270 |
| 7,229,155 | 6,830,318 | 7,195,342 | 7,175,261 | 7,465,035 |
| 7,108,356 | 7,118,202 | 10/773,186 | 7,134,744 | 10/773,185 |
| 7,134,743 | 7,182,439 | 7,210,768 | 7,465,036 | 7,134,745 |
| 7,156,484 | 7,118,201 | 7,111,926 | 7,431,433 | 7,018,021 |
| 7,401,901 | 7,468,139 | 11/188,017 | 7,128,402 | 7,387,369 |
| 11/329,157 | 11/097,308 | 7,448,729 | 7,246,876 | 7,431,431 |
| 7,419,249 | 7,377,623 | 7,328,978 | 7,334,876 | 7,147,306 |
| 09/575,197 | 7,079,712 | 6,825,945 | 7,330,974 | 6,813,039 |
| 6,987,506 | 7,038,797 | 6,980,318 | 6,816,274 | 7,102,772 |
| 7,350,236 | 6,681,045 | 6,728,000 | 7,173,722 | 7,088,459 |
| 09/575,181 | 7,068,382 | 7,062,651 | 6,789,194 | 6,789,191 |
| 6,644,642 | 6,502,614 | 6,622,999 | 6,669,385 | 6,549,935 |
| 6,987,573 | 6,727,996 | 6,591,884 | 6,439,706 | 6,760,119 |
| 7,295,332 | 6,290,349 | 6,428,155 | 6,785,016 | 6,870,966 |
| 6,822,639 | 6,737,591 | 7,055,739 | 7,233,320 | 6,830,196 |
| 6,832,717 | 6,957,768 | 7,456,820 | 7,170,499 | 7,106,888 |
| 7,123,239 | 10/727,181 | 10/727,162 | 7,377,608 | 7,399,043 |
| 7,121,639 | 7,165,824 | 7,152,942 | 10/727,157 | 7,181,572 |
| 7,096,137 | 7,302,592 | 7,278,034 | 7,188,282 | 10/727,159 |
| 10/727,180 | 10/727,179 | 10/727,192 | 10/727,274 | 10/727,164 |
| 10/727,161 | 10/727,198 | 10/727,158 | 10/754,536 | 10/754,938 |
| 10/727,160 | 10/934,720 | 7,171,323 | 7,278,697 | 7,369,270 |
| 6,795,215 | 7,070,098 | 7,154,638 | 6,805,419 | 6,859,289 |
| 6,977,751 | 6,398,332 | 6,394,573 | 6,622,923 | 6,747,760 |
| 6,921,144 | 10/884,881 | 7,092,112 | 7,192,106 | 7,457,001 |
| 7,173,739 | 6,986,560 | 7,008,033 | 11/148,237 | 7,222,780 |
| 7,270,391 | 7,195,328 | 7,182,422 | 7,374,266 | 7,427,117 |
| 7,448,707 | 7,281,330 | 10/854,503 | 7,328,956 | 10/854,509 |
| 7,188,928 | 7,093,989 | 7,377,609 | 10/854,495 | 10/854,498 |
| 10/854,511 | 7,390,071 | 10/854,525 | 10/854,526 | 10/854,516 |
| 7,252,353 | 10/854,515 | 7,267,417 | 10/854,505 | 10/854,493 |
| 7,275,805 | 7,314,261 | 10/854,490 | 7,281,777 | 7,290,852 |
| 10/854,528 | 10/854,523 | 10/854,527 | 10/854,524 | 10/854,520 |
| 10/854,514 | 10/854,519 | 10/854,513 | 10/854,499 | 10/854,501 |
| 7,266,661 | 7,243,193 | 10/854,518 | 10/934,628 | 7,163,345 |
| 7,465,033 | 7,452,055 | 7,470,002 | 11/293,833 | 7,475,963 |
| 7,448,735 | 7,465,042 | 7,448,739 | 7,438,399 | 11/293,794 |
| 7,467,853 | 7,461,922 | 7,465,020 | 11/293,830 | 7,461,910 |
| 11/293,828 | 7,270,494 | 11/293,823 | 7,475,961 | 11/293,831 |
| 11/293,815 | 11/293,819 | 11/293,818 | 11/293,817 | 11/293,816 |
| 7,448,734 | 7,425,050 | 7,364,263 | 7,201,468 | 7,360,868 |
| 10/760,249 | 7,234,802 | 7,303,255 | 7,287,846 | 7,156,511 |
| 10/760,264 | 7,258,432 | 7,097,291 | 10/760,222 | 10/760,248 |
| 7,083,273 | 7,367,647 | 7,374,355 | 7,441,880 | 10/760,205 |
| 10/760,206 | 10/760,267 | 10/760,270 | 7,198,352 | 7,364,264 |
| 7,303,251 | 7,201,470 | 7,121,655 | 7,293,861 | 7,232,208 |
| 7,328,985 | 7,344,232 | 7,083,272 | 11/014,764 | 11/014,763 |
| 7,331,663 | 7,360,861 | 7,328,973 | 7,427,121 | 7,407,262 |
| 7,303,252 | 7,249,822 | 11/014,762 | 7,311,382 | 7,360,860 |
| 7,364,257 | 7,390,075 | 7,350,896 | 7,429,096 | 7,384,135 |
| 7,331,660 | 7,416,287 | 11/014,737 | 7,322,684 | 7,322,685 |
| 7,311,381 | 7,270,405 | 7,303,268 | 7,470,007 | 7,399,072 |
| 7,393,076 | 11/014,750 | 11/014,749 | 7,249,833 | 11/014,769 |
| 11/014,729 | 7,331,661 | 11/014,733 | 7,300,140 | 7,357,492 |
| 7,357,493 | 11/014,766 | 7,380,902 | 7,284,816 | 7,284,845 |
| 7,255,430 | 7,390,080 | 7,328,984 | 7,350,913 | 7,322,671 |
| 7,380,910 | 7,431,424 | 7,470,006 | 11/014,732 | 7,347,534 |
| 7,441,865 | 7,469,989 | 7,367,650 | 7,469,990 | 7,441,882 |
| 11/293,822 | 11/293,812 | 7,357,496 | 7,467,863 | 7,431,440 |
| 7,431,443 | 11/293,811 | 11/293,807 | 11/293,806 | 7,467,852 |
| 7,465,045 | | | | |

The disclosures of these applications and patents are incorporated herein by reference.

BACKGROUND OF THE INVENTION

Inkjet printing is a popular and versatile form of print imaging. The Assignee has developed printers that eject ink through MEMS printhead IC's. These printhead IC's (integrated circuits) are formed using lithographic etching and deposition techniques typically used in semiconductor fabrication.

The micro-scale nozzle structures in MEMS printhead IC's allow a high nozzle density (nozzles per unit of IC surface area), high print resolutions, low power consumption, self cooling operation and therefore high print speeds. Such printheads are described in detail in U.S. Pat. No. 6,746,105 and U.S. Ser. No. 11/097,308 to the present Assignee. The disclosures of these documents are incorporated herein by reference.

The small nozzle structures and high nozzle densities can create difficulties with nozzle clogging, depriming, ink feed and so on. Ideally, the printer components are designed so that they inherently avoid or prevent conditions that can have detrimental effects on the print quality. However, in practice no printers are completely immune to the problems of depriming, clogging, flooding, outgassing and so on. This is especially so given the range of conditions that printers are expected to operate in, and the atypical conditions in which users operate or transport printers. Manufacturers can not predict the user treatment every printer will be subjected to during its operational life, so designing printer components to accommodate every eventuality is impossible not to mention impractical from a cost perspective.

SUMMARY OF THE INVENTION

Accordingly, the present invention provides an inkjet printer comprising:

a printhead integrated circuit (IC) with an array of nozzles for ejecting ink on to print media;

an ink supply reservoir for storing ink;

an ink supply line defining a flow path from the ink supply reservoir to the printhead IC; and, a valve in the ink supply line proximate the printhead IC selectively closing the flow path to the printhead IC.

The invention is predicated on the realization that printers designed to minimize the risk of typical problems occurring, as well as having inbuilt measures to take restorative action if and when a problem does arise, are far more practical in the real world. This rationale accepts that problems will occur in some printers, and a printer that can facilitate user correction of common printing problems will ultimately be more appealing to users.

Incorporating a shutoff valve into the ink line to the printhead IC minimizes color mixing across separate lines. Any pressure differences between the ink lines will equalize (from color mixing across the front of the printhead IC) much more quickly if the majority of each ink line is shut off from the printhead IC. This accepts that color mixing is likely to happen because of paper dust particles eventually bridging two nozzles of different colors, but it minimizes the detrimental impact. Furthermore, if the valve is downstream of a purge actuator, the color contamination can be corrected.

Fluidic isolation of the printhead IC during transport also minimizes the risk of ink leakage through the nozzles from any jarring or impacts.

Preferably the printer has a plurality of separate ink supply lines to the printhead IC, each of the ink supply lines having a respective valve in the ink supply line proximate the printhead IC selectively closing the flow path to the printhead IC. In a preferred embodiment, the printer further comprises an ink distribution element for supporting and distributing ink to the printhead IC, and a filter for removing bubbles and particulates from the ink to the printhead IC wherein the filter is immediately upstream of the ink distribution element and the valve is in turn, immediately upstream of the filter.

In a preferred embodiment, the printer further comprises a pulse damper positioned along the flow path; wherein during use, the pulse damper decreases the amplitude of pressure pulses in the ink.

In these embodiments the pulse damper may be part of a peristaltic pump mechanism.

In these embodiments it is preferable that the pulse damper is positioned upstream of the valve.

In these embodiments it is preferable that the pulse damper has a moveable interface with one side that, during use, contacts ink in the flow path, and an opposite side that contacts a compressible fluid.

In a further preferred form the pulse damper is proximate the printhead IC in the flow path.

In these embodiments it is preferable that the pulse damper is a chamber partially filled with ink in fluid communication with the flow path and partially filled with air.

If the pulse damper is part of a peristaltic pump mechanism, then it is preferable that the peristaltic pump mechanism has a length of elastically deformable ink conduit and a pinch device that can pinch shut the elastically deformable ink conduit and move to the downstream extent of the elastically deformable ink conduit, such that the elastically deformable ink conduit is the pulse damper, and the pinch device at the downstream extent of the elastic ink conduit is the valve that selectively closes the ink flow to the ink distribution element.

Preferably the ink supply reservoir is an ink cartridge with an air inlet valve, an ink outlet valve and a valve actuator that opens the air inlet valve in response to the ink outlet valve opening.

The printer may further comprise a pressure regulator in the ink flow line downstream from the ink cartridge, wherein during use the pressure regulator is biased shut and opens upon a threshold pressure difference between the upstream and downstream ink.

Preferably the ink distribution element is formed from a material with a Young's Modulus greater than high density polyethylene (HDPE).

In these embodiments it is preferable that the ink distribution element is moulded liquid crystal polymer (LCP). The peristaltic pump mechanism may be a purge actuator for forcing ink through the printhead IC and out of the array of nozzles.

The printer may further comprise a printhead maintenance head for collecting ink purged through the array nozzles in response to the purge actuator.

The printer may further comprise an ink sump wherein the maintenance head has an ink transfer arrangement to transfer the collected purge ink to the ink sump. The printhead maintenance head may have a perimeter seal to engage the printhead IC to seal the nozzle array from atmosphere.

The printer may also have a controller to coordinate the operation of the printhead maintenance head and the peristaltic pump mechanism.

Preferably the printhead IC is a pagewidth printhead IC.

BRIEF DESCRIPTION OF THE DRAWINGS

Preferred embodiments of the invention will now be described by way of example only with reference to the accompanying drawings, in which.

DETAILED DESCRIPTION OF PREFERRED EMBODIMENTS

The fluidic system of an inkjet printer using pagewidth inkjet printheads of the type developed by the Assignee, should satisfy several requirements. In particular, most printing applications will require some regulation of ink pressure at the printhead, provision for long term ink storage, printhead IC maintenance and the volumetric control of ink supply.

It is important to note that references to 'ink' throughout this specification should be interpreted as a functional fluid encompassing all types of printable fluid regardless of whether it is colored and intended to form visible images or indicia on a media substrate. The printhead may also eject infra-red ink, adhesive or a component thereof, medicament, volatile aromatic or any other functionalized fluid.

Fluidic System Overview

Figure 1:
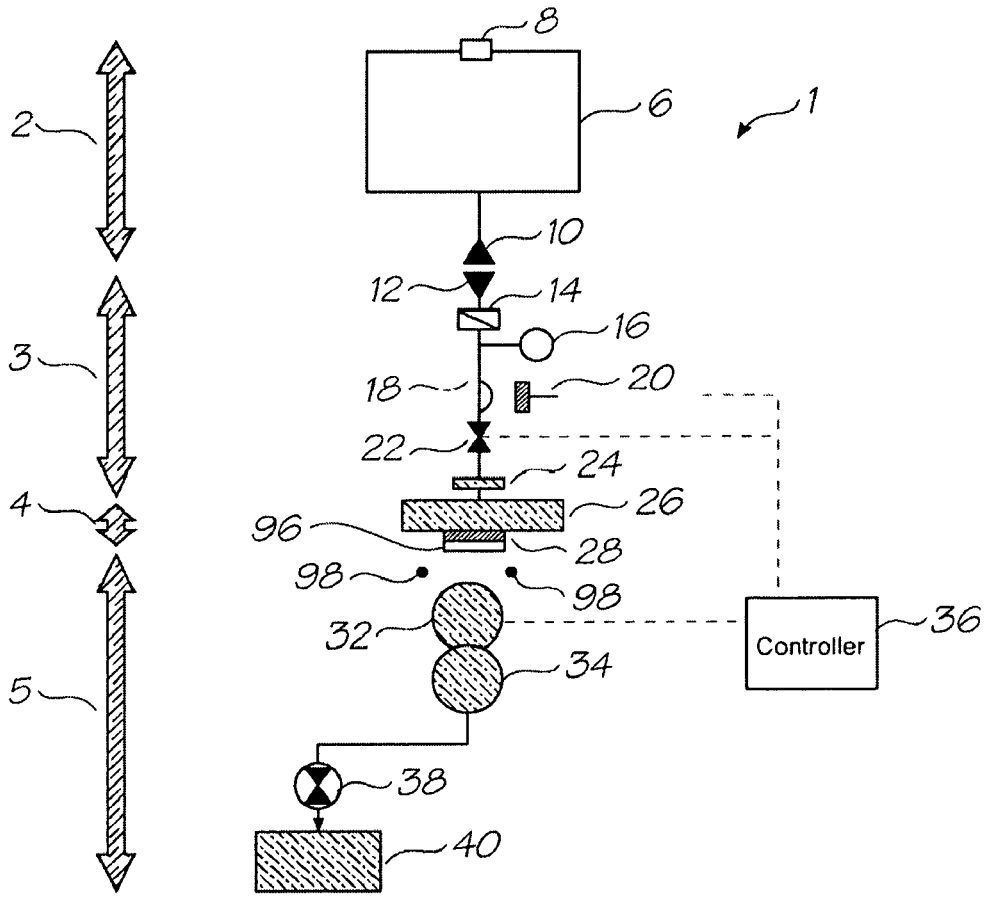
FIG. 1 is schematic overview of a fluidic system for a printer according to the invention.

FIG. 1 is a schematic overview of the fluidic system 1 in an inkjet printer. The system 1 has been divided into four sections; the ink tank 2, ink line and conditioning 3, printhead 4 and maintenance system 5. Each section is discussed in detail below.

Ink Tanks

The ink tanks 6 store a supply of ink for the printhead. The tanks are usually in the form of cartridges that detachably couple to the ink conditioning section 3. Ideally, the upstream coupling 10 and downstream coupling 12 form a connection that is free of leaks, bubbles and dust. In practice, this is difficult to achieve and some contaminants may need to be dealt with in the ink conditioning section 3.

Rigid Walled Cartridge

There are compelling reasons to store the ink in a flexible walled container or bag. The inks exposure to air is much less (it is not zero because of air permeation through polymer ink bags) and the bag can be mechanically biased to expand and thereby induce a 'negative' pressure (or less than atmospheric) in the printhead. A flexible ink bag type of cartridge and the benefits of a negatively pressurized printhead are described in U.S. Ser. No. 11/293,820 to the Assignee, the disclosure of which is incorporated herein by reference.

Unfortunately, the flexible bag type cartridge also has drawbacks. The amount of ink remaining in the bag when it requires replacement can be substantial. This ink is wasted and means that the cartridge is bigger than it 'needs' to be. This is because the negative pressure can drop below a deprime threshold as the cartridge bag becomes empty. The deprime threshold is the pressure at which the ink is sucked back out of the nozzle chambers and back into the cartridge.

Figure 2:
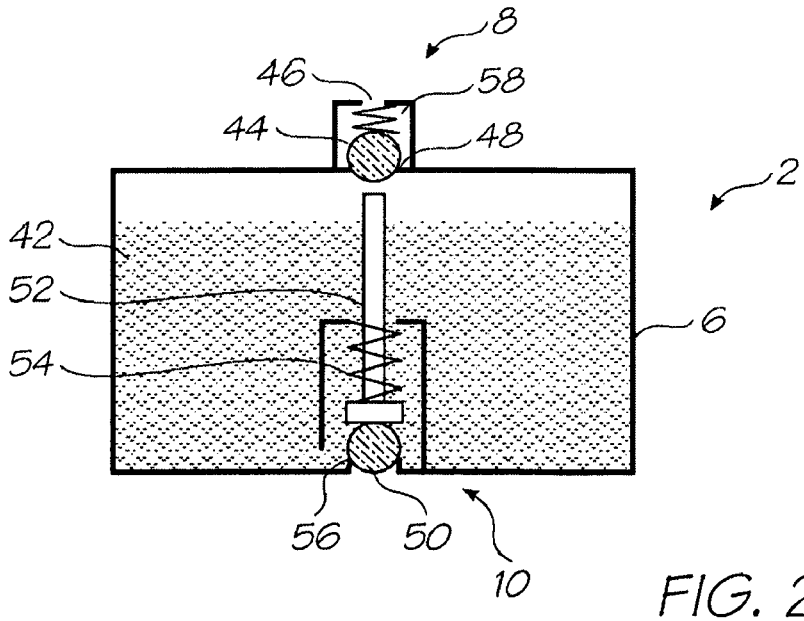
FIG. 2 is a schematic section view of the ink cartridge.

The cartridge used in the present system is a 'dumb' ink tank—it performs no function other than ink storage. The negative pressurization of the ink occurs in the ink conditioning section 3. FIG. 2 is a schematic representation of the ink cartridge 2. The ink tank 6 is a rigid walled container for storing the ink 42. When the cartridge 2 is installed in the printer, the downstream coupling 12 (FIG. 1) presses on the ink outlet ball 50 to unseat it from the ink outlet 56. In turn, the ink outlet ball 50 pushes the actuator shaft 52 upwards against the action of the outlet spring 54. The actuator shaft unseats the air inlet ball 44 from the internal air inlet 48 against the bias of the return spring 58. As ink 42 is used by the printhead, air is drawn through the external inlet 46, around the air inlet ball 44 and through the internal inlet 48.

The air inlet valve 8 needs to be large enough to allow sufficient air inflow so as to prevent any resistance to ink flow through the fluidic system 1. However, it should also be small enough to avoid ink leakage should the printer be inverted while the cartridge is installed. Ink leakage can be largely prevented by making the air inlet smaller than the capillary length of the ink as the ink flow closed by the shut off valve 22 described below. For water based inks, the capillary is typically about 2 mm.

Configuring the ink cartridge 2 to be a simple storage tank, instead of complicating its design with a pressure regulating function, reduces the manufacturing costs and allows the design to be easily varied to accommodate capacity changes.

Upstream/Downstream Couplings

It will be appreciated that removing the cartridge 2 automatically closes both inlet and outlets valves to prevent leakage. The figures show simple sketches of the upstream and downstream couplings 10 and 12 for purposes of illustration. However, both couplings are arranged to minimize any contaminants or air bubbles becoming entrained in the ink flow to the printhead. Suitable coupling designs are shown in U.S. Ser. No. 11/293,820 referenced above.

Pressure Regulator

The pressure regulator 14 ensures the pressure at the printhead IC 28 is less than atmospheric. A negative pressure at the printhead nozzles 96 (see FIG. 1 ) is necessary to prevent ink leakage. During periods of inactivity, the ink is retained in the chambers by the surface tension of the ink meniscus that forms across the nozzle. If the meniscus bulges outwardly, it can 'pin' itself to the nozzle rim to hold the ink in the chamber. However, if it contacts paper dust or other contaminants on the nozzle rim, the meniscus can be unpinned from the rim and ink will leak out of the printhead 28 through the nozzle.

To address this, many ink cartridges are designed so that the hydrostatic pressure of the ink in the chambers is less than atmospheric pressure. This causes the meniscus at the nozzles to be concave or drawn inwards. This stops the meniscus from touching paper dust on the nozzle rim and removes the slightly positive pressure in the chamber that would drive the ink to leak out.

The negative pressure in the chambers is limited by two factors. It can not be strong enough to de-prime the chambers (i.e. suck the ink out of the chambers) and it must be less than the ejection pressure generated by the ejection drop ejection actuators. However, if the negative pressure is too weak, the nozzles can leak ink if the printhead is jolted or shaken. While this can happen during use, it is more likely to occur during the shipping and handling of printheads primed with ink.

Figure 3A:
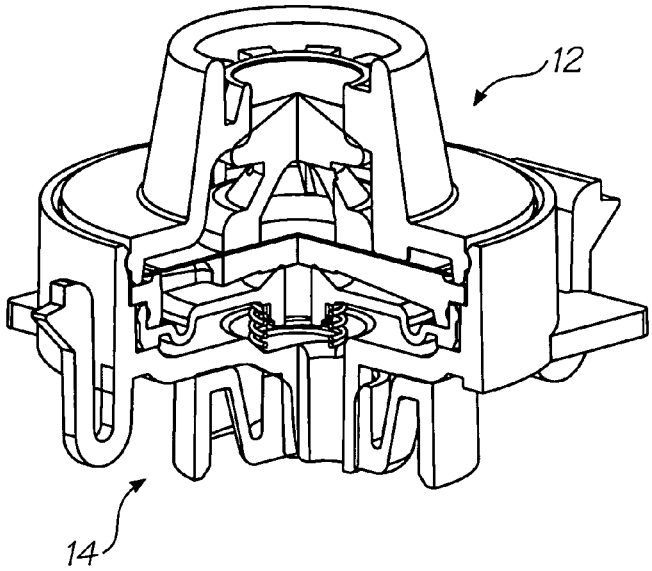
FIG. 3A is a section view of the pressure regulator.
Figure 3B:
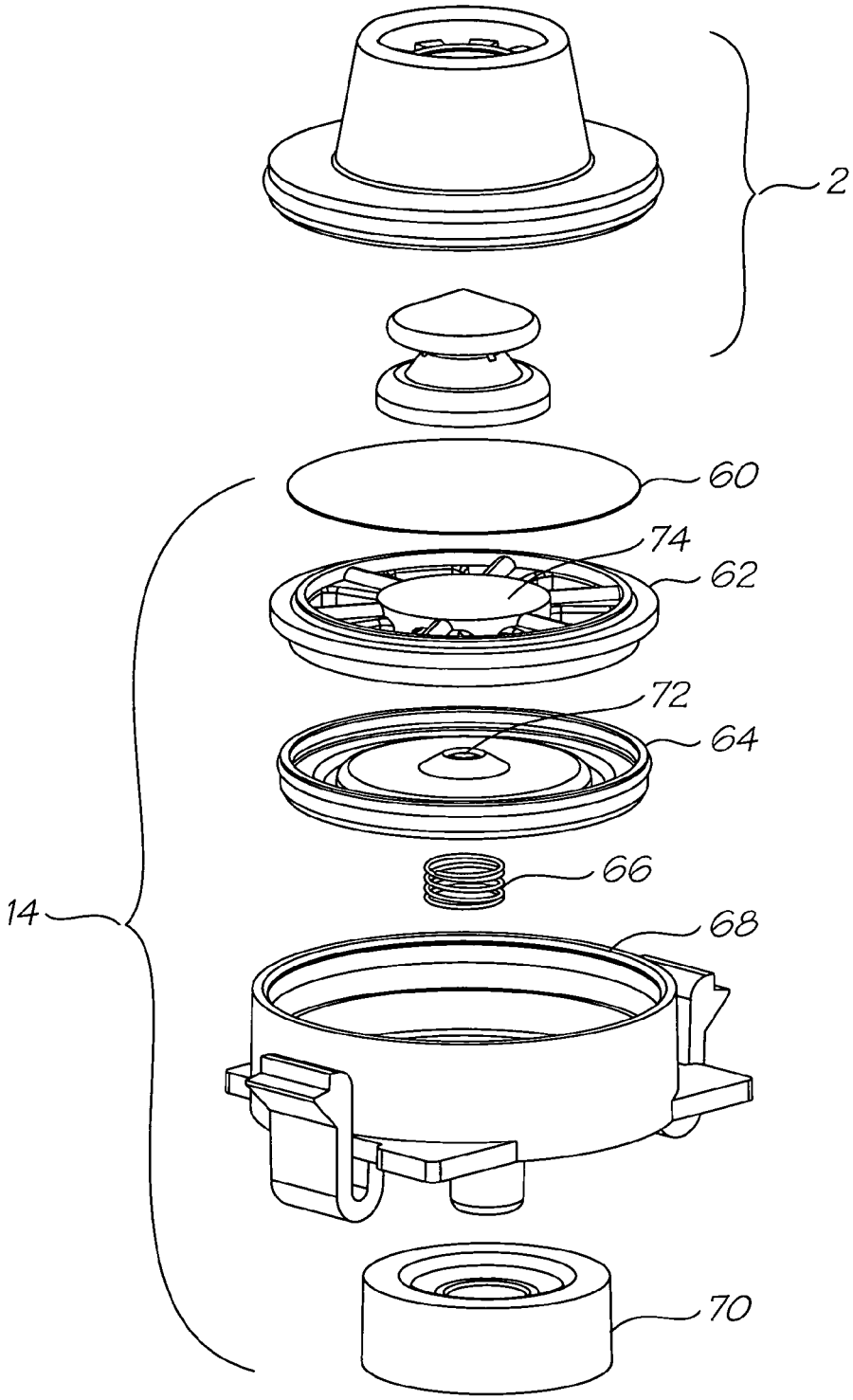
FIG. 3B is an exploded perspective of the pressure regulator.

The present system generates the negative pressure using the pressure regulator 14 instead of complicating the design of the ink cartridge 2 as discussed above. FIG. 3 shows the pressure regulator 14 and down stream coupling 12 used in the printer described in U.S. Ser. No. 11/293,820 referenced above. FIG. 3B is an exploded perspective for clarity. The pressure regulator 14 has a diaphragm 64 with a central inlet opening 72 that is biased closed by the spring 66. The hydrostatic pressure of the ink in the cartridge acts on the upper or upstream side of the diaphragm. The head of ink acting on the upstream side of the diaphragm will vary as the ink in the cartridge is consumed by the printhead. To keep the variation in the head of ink relatively constant, the ink tank 6 should have a relatively wide and flat form factor.

Acting on the lower or downstream surface of the diaphragm 64, are the combined pressures of the static ink pressure at the regulator outlet 70 and the regulator spring 66. As long as the downstream pressure and the spring bias exceeds the upstream pressure, the regulator inlet 72 remains sealed against the central hub 74 of the spacer 62.

During operation, the printhead IC 28 acts as a pump. The ejection actuators forcing ink through the nozzle array lowers the hydrostatic pressure of the ink on the downstream side of the diaphragm 64. As soon as the downstream pressure and the spring bias is less than the upstream pressure, the inlet 72 unseats from the central hub 74 and ink flows to the regulator outlet 70. The inflow through the inlet 72 immediately starts to equalize the fluid pressure on both sides of the diaphragm 64 and the force of the spring 66 again becomes enough to re-seal the inlet 72 against the central hub 74. As the printhead IC 28 continues to operate, the inlet 72 of the pressure regulator successively opens and shuts as the pressure difference across the diaphragm oscillates by minute amounts about the threshold pressure difference required to balance the force of the spring 66. As the diaphragm opens and shuts in rapid succession, and is only ever displaced by a minute amount, the annular diaphragm support 68 need only be very shallow. The rapid opening and closing of the valve lets the pressure regulator 14 maintain a relatively constant negative hydrostatic pressure in the down stream ink flow path.

For most of the Assignee's printhead IC's, the de-prime pressure threshold is in the range −100 mm $H_2O$ to −200 mm $H_2O$. Hence the pressure regulator should be set at a pressure difference that will not exceed the de-prime threshold of the nozzles (taking into account the head of ink from the regulator to the nozzles, and bearing in mind that the head of ink above the regulator 14 varies).

Needle valves can also be used for pressure regulation, but they are typically not configured for the ink flow rate required by the high speed pagewidth printheads developed by the Assignee. The diaphragm inlet 72 can easily accommodate the necessary flow rate and the rapid opening and closing of the valve during use.

Using a diaphragm valve for the pressure regulator 14 also presents a good opportunity to incorporate a filter 60. As the diaphragm 64 is necessarily wider than the rest of the ink flow path, the filter can be relative fine but not overly restrict the ink flow because it has a wide diameter.

Pulse Damper

The pulse damper 16 removes spikes in the ink pressure caused by shock waves or resonant pulses through the ink line. The shock waves occur when the ink flowing to the printhead is stopped suddenly, such as at the end of a print job or a page. The Assignee's high speed, pagewidth printhead IC's need a high flow rate of supply ink during operation. Therefore, the mass of ink in the ink line from the cartridge to the nozzles is relatively large and moving at an appreciable rate. Suddenly arresting this flow gives rise to a shock wave as the ink line is a rigid structure. The LCP moulding 26 (see FIG. 1) is particularly stiff and provides almost no flex as the column of ink in the line is brought to rest. Without any compliance in the ink line, the shock wave can exceed the Laplace pressure (the pressure provided by the surface tension of the ink at the nozzles 96 to retain ink in the nozzle chambers) and flood the front surface of the printhead IC 28. If the nozzles 96 flood, ink may not eject and artifacts appear in the printing.

Resonant pulses in the ink occur when the nozzle firing rate matches a resonant frequency of the ink line. Again, because of the stiff structure that define the ink line, a large proportion of nozzles 96 for one color, firing simultaneously, can create a standing wave or resonant pulse in the ink line. This can result in nozzle flooding, or conversely nozzle deprime because of the sudden pressure drop after the spike, if the Laplace pressure is exceeded.

Figure 4:
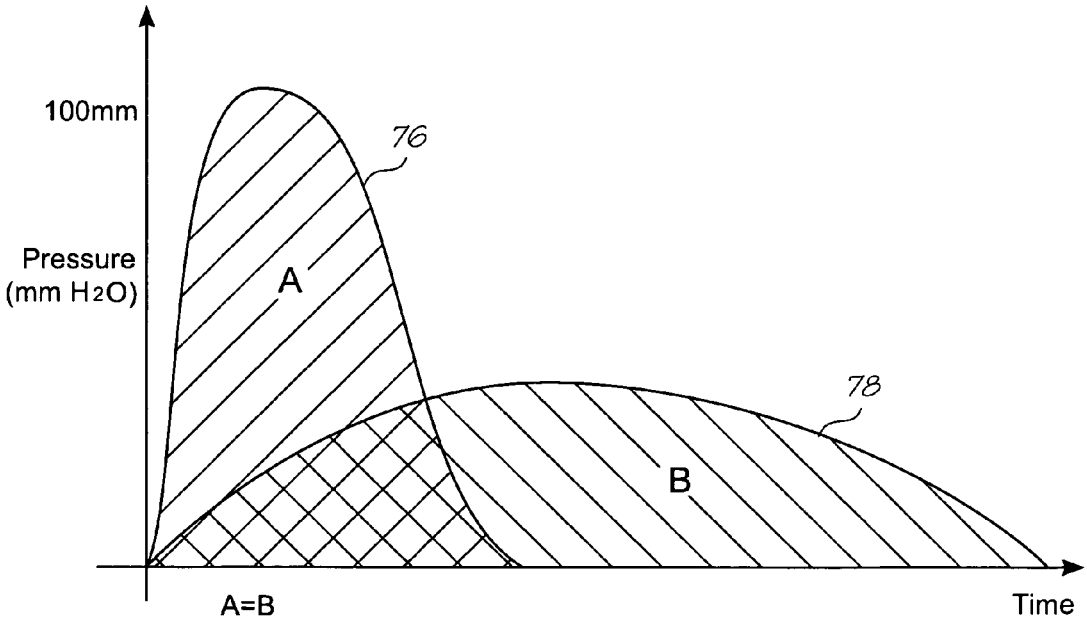
FIG. 4 is an illustrative graph of pressure pulses in a damped and undamped fluidic system.

To address this, the present fluidic system incorporates a pulse damper 16 to remove pressure spikes from the ink line. As shown in FIG. 4, the pressure spike 76 has a finite duration. The damped pulse 78 has a lower peak pressure but a longer duration. However, the energy dissipated in both systems (represented by areas A and B) is equal.

The damper 16 may be an enclosed volume that can be compressed by the ink. Alternatively, the damper may be a compliant section of the ink line that can elastically flex and absorb pressure pulses. In other forms, the damper 16 can be an apertured plate or internal baffles that create turbulent flow and dissipate the energy using eddy viscosity.

Ideally, the pulse damper 16 is physically located near the LCP moulding 26 so that it can slowly arrest the majority of the column of ink in the ink line. For an A4 pagewidth printhead, the damper should be within about 50 mm of the LCP moulding 26.

By damping the ink line and thereby removing large oscillations about a nominal negative pressure at the nozzles, the nominal negative pressure at the printhead can be lower than an undamped system. A lower negative pressure is advantageous as there is less chance of the ink leakage from the nozzles if the printhead is knocked or jarred during installation or handling.

Shutoff Valve

The shutoff valve 22 protects against deprime and color crosstalk. It is also used during printhead purging operations. The valve can take many different forms as long as it fluidically isolates the printhead from the rest of the ink line. The valves role in depriming, color crosstalk and purging is discussed below.

As discussed above, pagewidth printhead must be robust enough to not leak or be damaged during handling and installation. It should stay primed with ink regardless of its orientation and even modest shocks. If the ink line is open to the downstream coupling 12, pagewidth printheads deprime relatively easily. Small mechanical shocks, and even holding them vertically can provide enough hydrostatic head to overcome the Laplace threshold pressure and cause depriming.

A shutoff valve 22 immediately upstream isolates the ink in the printhead IC 28 and the LCP moulding 26. This substantially lowers the mass and therefore the momentum of ink acting at the nozzles 96. This guards against leakage from jolting and jarring while the printhead is handled prior to installation.

Color crosstalk occurs when one ink color flows into the ink line from another via the nozzles. This happens while the printhead is idle for a short time (less than an hour). If the nozzle face of the printhead IC 28 is wet from beaded ink or other fluid, there can be a fluid path between nozzles of different colors. Should the ink lines leading to the different colored nozzles have a pressure difference, the ink from the high pressure line will flow to the low pressure line until the pressure equalizes. If the crosstalk continues for several hours, the color mixing can be beyond recovery.

Printhead IC's with high nozzle densities (such as the Assignee's) are very prone to color mixing unless appropriate measures are taken. A single dust particle on the nozzle face can anchor beads of ink from different colored nozzles and effectively become a fluid bridge between the two. Similarly, perfectly equal pressure in all the ink lines is also practically impossible.

Shutoff valves 22 for each of the ink lines effectively arrest color mixing. The volume of ink in each line from the shutoff valve 22 to the nozzles 96 is low and a very small amount of color mixing occurs before the pressure equalizes.

Ink Purge

The present system uses an ink purge as part of the maintenance cycle. Purging ink clears dried ink from nozzles, and any color contaminated ink as well as other foreign particles. Ink purging is also an effective way of dealing with outgassing. Outgassing refers to the formation of bubbles in the ink line from dissolved gas (usually nitrogen) coming out of solution. Outgassing in the ink occurs when the printer stands idle for a day or so. Bubbles in the LCP molding can be particularly detrimental move to the printhead IC and prevent nozzles from firing. However, purging a relatively small volume of ink removes the bubbles. A purge involves flooding the printhead IC with ink and subsequently cleaning away the ejected ink. In the case of the Assignee's A4 pagewidth printhead, a purge volume of about 0.017 mm is sufficient (per color). The purging ink can be stored in a separate purge volume 18 connected to the ink line. The purge actuator 20 forces the ink into the line to flood the printhead IC. To do this, the ink line needs to be closed upstream of the purge actuator 20. A second shutoff valve 84 (described below in relation to FIG. 5A) is a convenient way of achieving this.

Figure 5A:
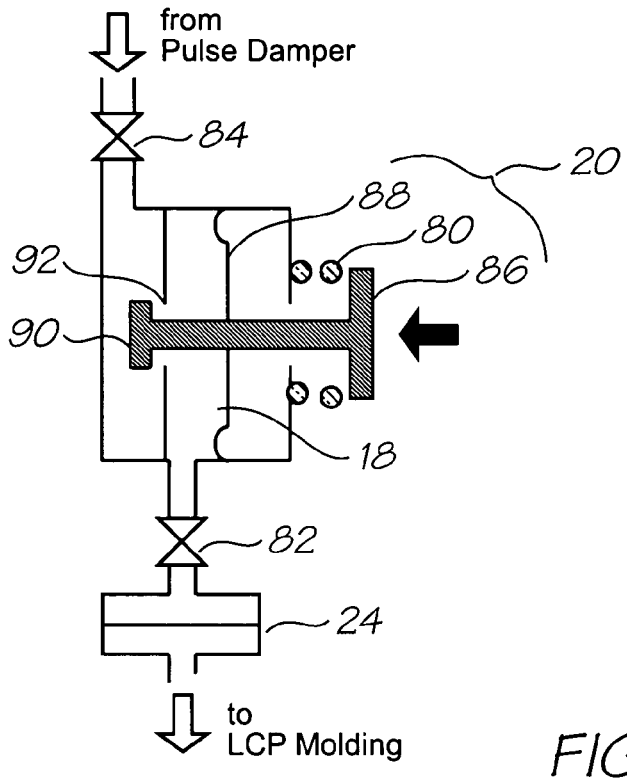
FIG. 5A is a diagram of a first type of purge actuator.
Figure 5B:
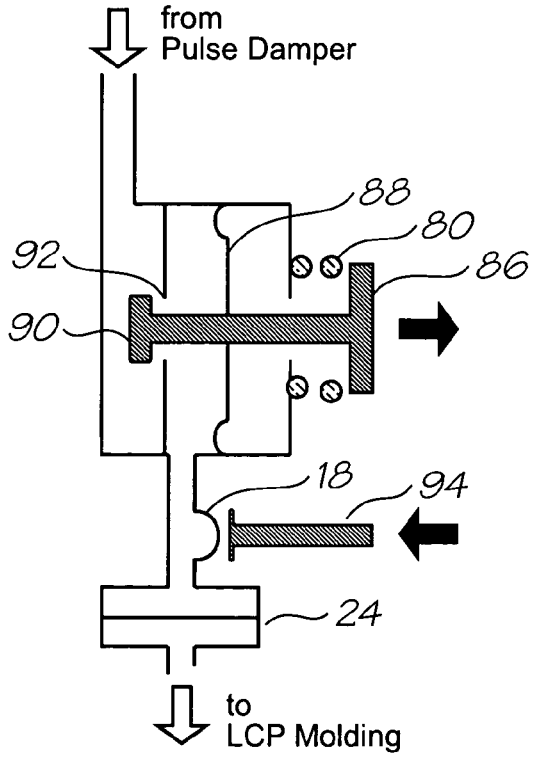
FIG. 5B is a diagram of a second type of purge actuator.

FIGS. 5A and 5B show two options for the purge mechanism. In FIG. 5A, the purge mechanism uses two shutoff valves 82 and 84. To initiate a purge, the controller closes the primary shutoff valve 82 and then opens the secondary shutoff valve 84. A solenoid or cam (not shown) drive the purge actuator 20 which comprises the diaphragm plunger 86, plunger return spring 80 and diaphragm 88. The internal end of the plunger 86 has a valve stem 90 that seals against the outlet 92 of the purge reservoir 18. Depressing the plunger 86 simultaneously unseats the valve stem 90 from the outlet 92 and ejects a set volume of purge ink by compressing the purge reservoir with the diaphragm 88.

While the plunger 86 is depressed, the controller closes the primary shutoff valve 82 and opens the secondary shutoff valve 84. As the return spring 80 retracts the plunger, the diaphragm 88 expands the purge reservoir 18 so that it refills with fresh ink.

After the purge, both valves 82 and 84 are opened for printing or closed for transportation of the printer.

Peristaltic Purge

The peristaltic purge mechanism shown in FIG. 5B has the advantage that it not need any shutoff valves which reduces the number of components in the ink line which in turn is simpler for the controller.

To initiate the purge, the diaphragm plunger 86 is pushed to close the pressure regulator 14. Then a peristaltic plunger 94 presses on a resilient purge reservoir 18 to eject the purge ink. With the pressure regulator preventing any reverse flow, the purge ink is directed into the LCP molding and through the printhead IC. Then the pressure regulator is re-opened and the peristaltic plunger B is slowly retracted to refill the resilient purge reservoir. Following this, the system is again ready for printing. As discussed above the pressure regulator opens only when there is a sufficient pressure difference across the diaphragm 64 (see FIG. 3B). To transport the printer, the diaphragm plunger 86 is actuated to shut the pressure regulator.

While this alternative dispenses with shutoff valves in favor of other components (in particular, the shutoff valve 22 is replaced with the pressure regulator 14), the ink line has significant compliance in it when being transported. As previously discussed, the printhead IC is least prone to any leakage if the fluidic system is completely rigid and still down stream of the shutoff valve 22, and the shutoff valve is immediately upstream of the LCP molding.

These concerns are addressed by providing the shutoff valve 22 and a purge mechanism using a peristaltic pump. A section of elastically deformable ink line is compressed by a roller or cam. The elastic ink line is pinched shut by the roller which then moves a small distance downstream to force a small volume of ink into the printhead. The section of elastic ink line along which the roller moves is the purge reservoir 18 and the roller is the purge actuator 20. If the roller then remains at the downstream end of the elastic ink line, it is also an effective shutoff valve 22. Ideally the roller moves to the very end of the elastic section of ink line as any compliance or lack of rigidity in the ink line downstream of the shutoff valve increases the risk of deprime.

Filter

All the components upstream of the printhead IC 28 are potential sources of contaminants. In light of this, the filter 24 should be installed as close as possible upstream of the printhead IC.

Mounting the printhead IC 28 to the filter 24 would be ideal but impractical. Therefore, in reality, the most practical site for the filter is on the upstream face of the LCP molding 26.

The size of the filter is a compromise between excluding particles big enough to be trapped in the structures of the printhead IC 28, and not adding excessive flow resistance. Testing on the Assignee's printheads showed a 3 micron (pore size) filter does not adversely affecting the fluid flow and removes the vast majority of particles that can lodge in the printhead IC 28.

The filter 24 also acts as an effective bubble trap. As discussed above, bubbles can be introduced into the ink line when the cartridge is changed or as the result of outgassing. A 3 micron filter will act as an effective bubble trap.

LCP Molding

The molding 26 is made from a liquid crystal polymer (LCP) which offers a number of advantages. It can be molded so that its coefficient of thermal expansion (CTE) is similar to that of silicon. It will be appreciated that any significant difference in the CTE's of the printhead IC 28 and the underlying moldings can cause the entire structure to bow. However, as the CTE of LCP in the mold direction is much less than that in the non-mold direction (~5 ppm/° C. compared to ~20 ppm/° C.), care must be take to ensure that the mold direction of the LCP moldings is unidirectional and aligned with the longitudinal extent of the printhead integrated circuit (IC) 28. LCP also has a relatively high stiffness with a modulus that is typically 5 times that of 'normal plastics' such as polycarbonates, styrene, nylon, PET and polypropylene.

It is also important to minimize the shedding of particulates from the LCP molding after production. In this regard, it is necessary to consider the compatibility of the ink with the LCP as well and the molding process.

Printhead IC

The printhead IC 74 is mounted to the underside of the LCP molding 26 by a polymer sealing film (not shown). This film may be a thermoplastic film such as a PET or Polysulphone film, or it may be in the form of a thermoset film, such as those manufactured by AL Technologies and Rogers Corporation.

The polymer sealing film is a laminate with adhesive layers on both sides of a central film, and laminated onto the underside of the LCP molding. A plurality of holes are laser drilled through the adhesive film to coincide with the centrally disposed ink delivery points for fluid communication between the printhead IC 28 and the channels in the LCP molding.

The thickness of the polymer sealing film is critical to the effectiveness of the ink seal it provides. The polymer sealing film seals the etched channels on the non-ejection side of the printhead IC. It also seals the conduits on the LCP molding. However, as the film seals across the open end of the channels in the printhead IC, it can also bulge or sag into opening in the LCP molding. The sagging section of film runs across several of the etched channels in the printhead IC and may cause a gap that allows cross contamination of the ink colors.

On the ink ejection side of the printhead IC 28, the surface is flat. With a flat surface, the maintenance regime can incorporate wiping and blotting procedures. While these procedures are effective maintenance techniques, they require the printhead IC to have a robust flat surface. However, the encapsulate covering the wire bonds sits proud of the planar nozzle surface and creates a ridge along which dust and dried ink can collect. To address this, the printhead IC can have a redundantly wide section alongside the wire bonds so that any blotting or wiping around the nozzles 96 is not impeded. This is a compromise solution as the larger printhead IC will lower the chip yield from each silicon wafer, thereby increasing fabrication costs.

Printhead Maintenance

Printhead maintenance prevents and corrects a number of non-printing printhead states that can give rise to drying, fouling, flooding and depriming. The maintenance facilities in the present fluidic system includes perimeter seals, shut off valves, purges, wiping and or blotting mechanisms and keep wet dots.

The perimeter seal 98 retards drying when the printer is idle for long periods. It also shields the nozzles 96 from dust when not in use. It should also be noted that a perimeter seal 98 does not use ink to operate and so is not detrimental to ink usage efficiency. However, it does not keep the printhead hydrated indefinitely, particularly in hot weather. While a seal can help prevent contamination, it can not correct contamination once it occurs. Similarly, it can not correct a dried printhead or a de-primed printhead.

As discussed in the 'Shutoff Valve' subsection above, shutoff valves can suppress color mixing through nozzles to ink lines at different hydrostatic pressures. They also give the printhead additional resistance to de-priming because of knocks or jolts during installation or handling. However, they can also promote de-priming as any drying of the ink will significantly reduce its volume and cause it to retreat back into the printhead IC 28. In light of this, shut-off valves are best used in conjunction with a perimeter seal (capper) and a re-priming mechanism.

Purging is one mechanism for re-priming the printhead (or in other words, recovering a printhead from de-prime). It can also be used for removing particulate contaminants and recovering a dried printhead. Unfortunately, ink purges necessarily waste ink, and the waste ink needs to be transported to a sump 40. Furthermore, ink purging can lead to ink color crosstalk. In light of this, ink purges should be used sparingly. Peristaltic pumps are best suited to providing the flow of purge ink as they accurately deliver a relatively precise volume to the printhead IC 28. Accordingly, each purge uses only as much ink as necessary and wastage is keep to a minimum.

Purged ink will remain on the nozzle face of the printhead IC 28 until it is cleared by a separate mechanism. As the purge clears particulate contaminants, the clearing mechanism needs to cope with a particulate burden as well the ink. A wide range of mechanisms have this ability, however a rotating belt mechanism has been found to be effective. However, it is relatively complex and uses a consumable film (used for the belt).

FIG. 1 shows the double roller mechanism 32, 34 developed to transport large volumes of ink at high rates. This purge ink removal mechanism is described in much greater detail in co-pending application no. (Our Docket FNE010US) the contents of which are incorporated herein by reference. This mechanism 32, 34 has the advantage that it does not actually contact the nozzle face of the printhead IC 28 in order to remove the purge ink, so there is no risk of nozzle damage or nozzle contamination by the roller 32. It also removes a particulate burden which can be disposed of with a doctor blade to prevent build up.

Keep wet dots are also incorporated into the maintenance regime to keep the nozzles 96 hydrated during printing or when the printer is powered up but not currently operating. Ordinary workers will readily understand the use and implementation of keep wet dots having regard to nozzle decap times and ambient conditions. For brevity, a detailed discussion is not provided here but refer to U.S. Ser. No. 11/097,308 for additional information.

The coordinated operation of the individual components in the maintenance regime will require a controller 36. The controller 36 needs to operate the associated mechanical drives and the printhead IC 28 in the following modes:

- Long Term Storage—for storage spanning days or years, and subsequent power up of the printer, the controller needs to close the perimeter seal 98, close the shutoff valves and then initiate a wake-up cycle that opens the shutoff valves and performs one or more purges before ejection of any transient colour mixing.
- Short Term Storage—for storage spanning minutes to hours (e.g. between print jobs), the controller needs to close the perimeter seal, close the shutoff valves and then initiate a wake-up cycle that opens the shutoff valves and performs one or more purges before ejection of any transient colour mixing.
- During Printing—the controller is to fire keep wet drops as required.
- User Request—in response to a user initiated request or initiated by de-priming or particulate fouling, the controller closes the shutoff valves and commences a cleaning cycle with one or more purges followed by ejecting the transient colour mixing.

Ink Transport

Waste ink is generated by purging and ejection of mixed colour ink. The waste ink must be actively transported to the sump 40 as the ink can not be uncontrolled within the printer. Therefore, the ink transfer mechanism must have the capacity to collect and transfer the volumes of ink generated during 'worst case' operating conditions in terms of waste ink production. The collection phase is the removal of ink from the nozzle plate of the printhead IC 28 while the transfer phase moves the collected ink to the sump 40.

Waste ink produced by purging or ejection of colour mixed ink should be rapidly removed from the printhead IC with a process that does not contaminate the nozzles. To complicate matters, there is little available adjacent the printhead. The vicinity is generally crowded with media feed mechanisms and capping structures and so on. Therefore the mechanism that collects the ink will not usually be able to accommodate the volume of waste ink produced over the life of a cartridge.

The porous or soft roller 32 in the dual roller design of FNE010US is capable of a high rate of ink removal while not actually contacting the printhead IC 28. The soft roller 32 is pressed against a parallel hard roller 34 that is partially enclosed by an absorbent body. Ink removed from the printhead IC 28 adheres to the soft roller surface until it meets the nip between the rollers. There it transfers to the hard roller 34 (polished stainless steel) and is drawn over its surface and into the absorbent material in the sump 40.

Sump

The sump 40 is necessary for controlled storage of the waste ink. However, as the sump 40 has a finite capacity, it is necessary to decide whether the sump 40 is to be replaceable or if it is to be sized such that its capacity exceeds the expected operational life of the printer.

A relatively small replaceable sump may only need to be replaced a few times during the life of the printer because evaporation reduces the volume of the ink. However, the ambient operating conditions for SOHO printers can vary widely. It may be the case that the absorbent material draws additional moisture from the air.

The sump 40 could simply be a container. However, for better ink retention in all orientations, a foam filled structure is to be preferred. Likewise a cellulose blotter or absorbent polymer will readily draw ink away from the transfer roller 34.

The fluidic system from cartridge to sump has been described herein by way of illustration only. Workers in this field will recognize many alterations and variations to the specific embodiments discussed above.

We claim:

1. An inkjet printer comprising:

a printhead integrated circuit (IC) with an array of nozzles for ejecting ink on to print media;

an ink supply reservoir for storing ink;

an ink supply line defining a flow path from the ink supply reservoir to the printhead IC;

a valve in the ink supply line proximate the printhead IC selectively closing the flow path to the printhead IC;

a pulse damper positioned along the flow path for decreasing the amplitude of pressure pulses in the ink, the pulse damper forming part of a peristaltic purge mechanism;

an ink purge actuator for forcing a volume of ink out of the printhead under pressure; and, a printhead maintenance system having a roller mechanism for rotating such that the roller surface collects ink purged from the printhead and draws the ink away, wherein the peristaltic purge mechanism has a length of elastically deformable ink conduit and a pinch device for pinching shut the elastically deformable ink conduit and moving to the downstream extent of the elastically deformable ink conduit, such that the elastically deformable ink conduit is the pulse damper, and the pinch device at the downstream extent of the elastic ink conduit is the valve that selectively closes the ink flow to the ink distribution element.

2. An inkjet printer according to claim 1 wherein the printer has a plurality of separate ink supply lines to the printhead IC, each of the ink supply lines having a respective valve in the ink supply line proximate the printhead IC selectively closing the flow path to the printhead IC.

3. An inkjet printer according to claim 1 further comprising an ink distribution element for supporting and distributing ink to the printhead IC, and a filter for removing bubbles and particulates from the ink to the printhead IC wherein the filter is immediately upstream of the ink distribution element and the valve is in turn, immediately upstream of the filter.

4. An inkjet printer according to claim 1 wherein the pulse damper is positioned upstream of the valve.

5. An inkjet printer according to claim 4 wherein the pulse damper is proximate the printhead IC in the flow path.

6. An inkjet printer according to claim 1 wherein the pulse damper is a chamber partially filled with ink in fluid communication with the flow path and partially filled with air.

7. An inkjet printer according to claim 1 wherein the ink supply reservoir is an ink cartridge with an air inlet valve, an ink outlet valve and a valve actuator that opens the air inlet valve in response to the ink outlet valve opening.

8. An inkjet printer according to claim 1, further comprising a moulding to which the printhead IC is attached, the moulding having defined therethrough a plurality of channels for effecting fluid communication with the printhead IC, wherein the moduling is formed from a material with a Young's Modulus greater than high density polyethylene (HDPE).

9. An inkjet printer according to claim 8, wherein the moulding is a moulded liquid crystal polymer (LCP).

10. An inkjet printer according to claim 1, wherein the roller mechanism comprises a soft roller and a hard roller, the hard roller arranged parallel to the soft roller and configured to contact in counter rotation with the soft roller to remove ink from the soft roller.

11. An inkjet printer according to claim 10 wherein the printhead maintenance system has an ink sump for ink on the transfer roller.

12. An inkjet printer according to claim 11 wherein the printhead system has a perimeter seal to engage the printhead IC to seal the nozzle array from atmosphere.

13. An inkjet printer according to claim 10 further including a controller to coordinate the operation of the printhead maintenance system and the peristaltic purge mechanism.

* * * * *